United States Patent [19]

Pilant et al.

[11] Patent Number: 4,616,710

[45] Date of Patent: Oct. 14, 1986

[54] HEAT-RELEASED PLUG

[76] Inventors: Frank J. Pilant, P.O. Box 634, Pine Valley, Calif. 92062; Milton D. Cornsweet, 3608 Lorimer La., Encinitas, Calif. 92024

[21] Appl. No.: 686,689

[22] Filed: Dec. 27, 1984

[51] Int. Cl.[4] ..... A62C 37/18

[52] U.S. Cl. ..... 169/41; 138/89; 138/98; 169/37; 411/34

[58] Field of Search ..... 169/37, 38, 40, 41, 169/39, 90; 411/34, 43, 70, 525–527; 138/89, 98

[56] References Cited

U.S. PATENT DOCUMENTS 3,021,927 2/1962 McKee, Jr. ..... 411/34 X

*Primary Examiner*—Jeffrey V. Nase

*Attorney, Agent, or Firm*—Charmasson & Holz

[57] ABSTRACT

A heat-released plug for temporarily stopping the flow of fluids from a variety of opening. The basic plug is normally installed and mostly comprised of simple and inexpensive components from diverse areas, adapted to function as a temporary stopper. A pliable elastomer provides the sealing surface which is expanded and held in place by a common shaft, washers and a simple fastener. The assembly is installed using a pop-rivet gun. In one configuration for sprinkler heads, a fusible link is provided, which, when exposed to sufficient heat, releases the pliable elastomer allowing the sprinkler to function again. This configuration allows fire safety personnel to stop the flow of water from actuated automatic sprinklers, use only one hand and a pop-rivet gun with a plug which will again allow the sprinkler system to function in the event the fire rekindles, increasing the effectiveness and safety of fire personnel.

12 Claims, 5 Drawing Figures

HEAT-RELEASED PLUG

FIELD OF THE INVENTION

This invention relates to stoppers and more specially to sprinkling flow regulation.

BACKGROUND OF THE INVENTION

A variety of plugs and stoppers have been developed to limit or shut off the flow of liquids from an opening. Many are simply inserted by hand into the opening. This type can be easily removed and reused, but is generally limited to restraining liquids near atmospheric pressure. Other plugs are more forcefully inserted by mechanical means to restrain liquids at higher pressures. This type requires equipment and/or destruction of the plug to remove.

An expandable plug is commonly used for temporary, but reliable sealing of higher pressure fluids. Expandable plugs provide an elastomeric sealing surface which is expanded by compression in an orthogonal direction. Compression is affected by mechanical cams, toggles or linkage assemblies.

These existing temporary plugs require special mechanical components, designed for opening to be stopped. The amount of compression must be adequate to insure reliable sealing under pressure, but excessive force will destroy the elastomer or fluid opening. The mechanical components must also fit into the available space in and near the opening. Space for actuating means must also be provided. Release of existing expandable plugs also requires mechanical force and the associated space and means to apply it. Because of these limitations, each expandable plug only fits a small range of openings. This is especially true of plugs for automatic sprinkler heads.

SUMMARY OF THE INVENTION

The principal and secondary objects of the invention are:

to provide a heat-released plug using inexpensive and readily available hardware;

to provide a heat-released plug that can be quickly installed using one hand;

to provide a heat-released plug that will reliably seal against fluids at elevated pressures;

to provide a heat-released plug that will seal a variety of fluid openings; and, in one configuration;

to provide a heat-released plug that will release the fluid flow upon fusing of a fusible link.

These and other objects are achieved by providing a cylindrical or conical elastomeric body with a bore partially or fully extending through the axis. A shaft such as a nail extends the length of the bore with a nonisotropic self-gripping fastener on the nail shaft. Radial expansion of the elastomeric body and sealing is accomplished by simultaneously pulling on the nail shaft and pushing on the nonisotropic fastener with a pop-rivet gun, affecting axial compression of the elastomeric body. The preferred embodiment also includes a fusible spacer between the elastomeric body and the fastener or head of the nail which, when sufficient heat is applied, melts, removing the expansion force and allowing the plug to fall away from the opening.

DESCRIPTION OF THE PREFERRED EMBODIMENTS

Figure 1:
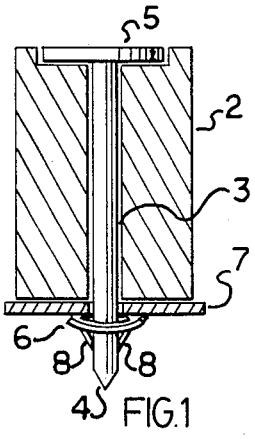
FIG. 1 is a cross sectional view of a heat-released plug ready to be inserted into or at a fluid opening, prior to expansion.

Referring now to the drawings, FIG. 1 shows an expandable plug prior to insertion or distortion. A resilient body or molded rubber body 2 is cylindrical in shape. The outside diameter is selected to be slightly smaller than the fluid opening to be plugged. A bore 3 is provided along the rubber body's centerline axis. A rod, or in this case a nail 4, extends through bore 3. The resilient body 2 is prevented from translating along the nail 4 in one direction by a means for stopping, or in this case, the head of the nail 5. Translation in the opposite direction is provided by ba nonisotropic means for fastening, or in this case, a stamped sheet metal fastener 6. This fastener may be a Tinnerman TM fastener, sold by the Eaton Manufacturing Co. A washer 7 is placed inbetween the fastener and the resilient body to distribute the distortion forces. The fastener 6 only grips the nail shaft 4 in one direction allowing it to be slid onto the nail 4 when the fastener is pushed in the direction of the resilient body or molded rubber 2 with stamped arms 8 trailing. However, when motion or force in opposite direction is attempted, the stamped arms grab or fasten onto the shaft of the nail 4.

Figure 2:
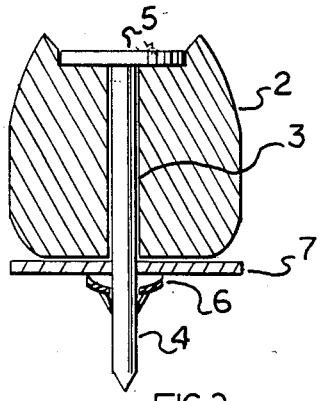
FIG. 2 is a cross sectional view of a heat-released plug after expansion.

FIG. 2 illustrates the expanded condition. The rubber 2 has been distorted by applying a pulling force on the nail shaft 4 simultaneously with pushing on fastener 6. This distortion force can be applied by a hand held pop-rivet gun, not shown. This distortion force has translated the fastener 6 and the washer 7 towards the head 5. The axial compression results in a radial expansion of the rubber body 2. The compression seals the bore 3 as well as expanding the outside diameter to seal against the fluid opening.

Figure 3:
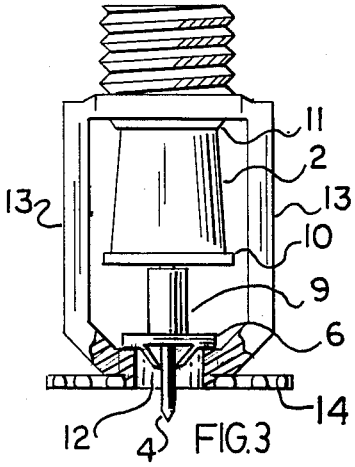
FIG. 3 is a side view of a heat-released plug with a fusible link installed in a sprinkler head.

FIG. 3 illustrates a variation in the expandable plug for application to a sprinkler head. The rubber body 2 here is a tapered cylinder or a conical shape. This configuration includes a fusible cylindrical spacer 9 placed inbetween the fastener 6 and the deflector washer 10 around nail shaft 4. The deflector washer 10 is similar to the washer 7 in that it distributes the distortion load, but the deflector washer extends beyond the base of the cylinder or cone to deflect and distribute the spray of water if the plug remains in place and the sprinkler actuated. Water actuation would occur if, after placement of the expandable plug in the sprinkler head as shown in FIG. 3, a fire or heat were to melt or fuse the spacer 9. This would remove the compression and radial expansion unsealing fluid opening 11. Gravity and water pressure would force translation of rubber body 2 and deflector washer 10 towards support hole 12 in support arms 13. This translation allows the full flow of water from the sprinkler to extinguish the fire or cool the heat which caused the fusible spacer 9 to melt. Deflector 14 is attached to support arms 13 for added distribution.

Figure 4:
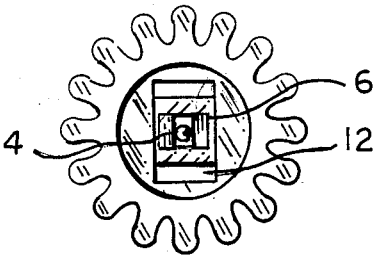
FIG. 4 is a bottom view of the sprinkler head installation.

FIG. 4 illustrates the bottom view of FIG. 3 which shows the outline of support hole 12 as a rectangle. In the orientation shown of the nail shaft 4 and fastener 6 the plug assembly is supported by the support arms 13. A 90 degree rotation, however, allows the fastener 6 to pass through support hole 12. Lateral support is provided by the support arms and support hole. The support hole allows rotation and removal of the fastener 6 replacement of the fusible cylinder 9 and fastener 6 resulting in a recockable plug. This configuration shown in FIGS. 3 and 4, provides a recockable sprinkler head plug requiring a minimum of labor and parts to reset.

Figure 5:
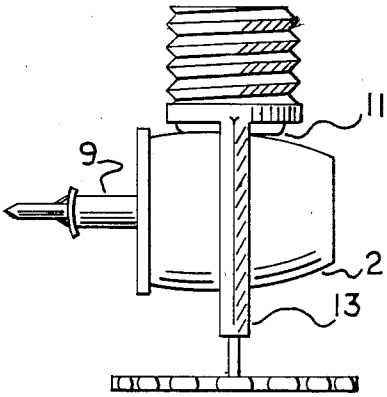
FIG. 5 is a side view of a heat-released plug in an alternate lateral installation in a sprinkler head.

FIG. 5 illustrates a laterally inserted plug. The rubber body 2 is deformed inside support arm 13 affecting a sealing of opening 11. If fusible spacer 9 melts, rubber body 2 relaxes allowing water to flow past opening 11.

The use of rubber body 2 with a conical or tapered cylinder shape with axial or lateral sealing ability, provides a device to reliably seal a variety of automatic sprinkler heads. These include: ceiling pendant or flush mounting heads, sidewall mounting heads, and upright mounting sprinkler heads. The use of a fusible spacer provides an easy reset, resulting in increased safety over conventional plugs.

While the preferred embodiment of the invention in various configurations has been described, other embodiments and configurations may be devised without departing from the spirit of the invention and the scope of the appended claims.

What is claimed is:

1. A heat-released plug assembly for obstructing the flow of fluid from an opening which comprises:

a resilient, generally cylindrical body having an axial bore therethrough;

a rod engaged through said bore;

a barrier at one end of said rod for stopping the axial translation of said body along said rod;

a fusible spacer mounted between said body and the other end of said rod; and means engaged over the other end of the rod and against said spacer for compressing the body axially against said barrier, including a self-gripping means for limiting the recoiling movement of said body.

2. The plug assembly in claim 1 wherein said resilient body is a molded rubber body.

3. The plug assembly claimed in claim 2 wherein said means for compressing comprises a washer placed on said rod inbetween said gripping means and said resilient body.

4. The plug assembly claimed in claim 3 wherein said rod is a nail.

5. The plug assembly in claim 4 wherein said barrier is the head of said nail.

6. The plug assembly in claim 5 wherein said gripping means is a sheet metal fastener.

7. The plug assembly claimed in claim 6 wherein said sheet metal fastener is a Tinnerman TM fastener.

8. The plug assembly claimed in claim 1 wherein said fusible spacer has a length commensurate with the extent to which the body may be compressed against said barrier.

9. The plug assembly claimed in claim 8 used in combination with an outlet having said opening and a support arm extending from the side of said opening to an area distally facing said opening, said plug assembly being shaped and dimensioned to allow said barrier and said body to be inserted axially into said opening and said fastener to be further restrained from recoil by said support arm.

10. The plug assembly claimed in claim 9 wherein said body is shaped and dimensioned to be inserted between said opening and said arm in axial orientation perpendicular to the axis of said opening.

11. The plug assembly claimed in claim 9 wherein the area of said arm facing said opening has an irregular aperture shaped and dimensioned to pass said rod irrespective of rotation and to pass said gripping means attached to said rod in one orientation, but not to pass said gripping means in another orientation.

12. The plug assembly claimed in claim 10 wherein said opening is the water spout of a fire-preventing, ceiling-sprinkler head.

* * * * *